US006378529B1

(12) United States Patent
Clemente Marco

(10) Patent No.: US 6,378,529 B1
(45) Date of Patent: Apr. 30, 2002

(54) APPLICATION TOOTH FOR THE HAIR AND/OR SCALP TREATMENT

(76) Inventor: Juan Carlos Clemente Marco, Virgen de Garcia, 10 - 2º, 02660 Caudette, Albacete (ES)

( * ) Notice: Subject to any disclaimer, the term of this patent is extended or adjusted under 35 U.S.C. 154(b) by 0 days.

(21) Appl. No.: 09/720,935

(22) PCT Filed: Jun. 30, 1999

(86) PCT No.: PCT/ES99/00201

§ 371 Date: Feb. 15, 2001

§ 102(e) Date: Feb. 15, 2001

(87) PCT Pub. No.: WO00/00057

PCT Pub. Date: Jan. 6, 2000

(51) Int. Cl.[7] ..... A45D 24/16; A45D 24/22; A45D 24/00

(52) U.S. Cl. ..... 132/111; 132/112; 132/114; 132/162

(58) Field of Search ..... 132/111, 162, 132/112, 163, 113, 114, 116, 109, 108, 148

(56) References Cited

U.S. PATENT DOCUMENTS 1,435,911 A * 11/1922 Bechtold ..... 132/163
1,594,636 A * 8/1926 Smith ..... 132/162
2,139,904 A * 12/1938 Merrill ..... 132/162
2,792,007 A * 5/1957 Parmer ..... 132/162
2,922,425 A * 1/1960 Lerner et al. ..... 132/162
5,154,193 A * 10/1992 Busch et al. ..... 132/110
6,067,997 A * 5/2000 Gueret ..... 132/218

* cited by examiner

*Primary Examiner*—John J. Wilson
*Assistant Examiner*—Robyn Kieu Doan
(74) *Attorney, Agent, or Firm*—Klauber & Jackson

(57) ABSTRACT

A device usable as an applicator comb, comprising a collection of applicator teeth inserted into a tubular body (1) as supporting element, permitting liquid or gelatinous products to be applied precisely and economically, by having attached to the device a container or receptacle holding the treatment product. For hair and scalp treatment, the product enters the applicator teeth (2, 2$^{I}$, 2$^{II}$, 2$^{III}$, 2$^{IV}$, 2$^{V}$. The product to be applied may cover all, only the sides or only the base of the applicator teeth, depending on whether the treatment is to be given on the totality of the hair and scalp, only on the hair, or on the base of the hair and in the scalp. Depending on the application, the tooth structure has a rigid core constituting the support for a permeable, peripheral cladding (13), or only a lateral cladding (12), without reaching the end.

8 Claims, 2 Drawing Sheets

APPLICATION TOOTH FOR THE HAIR AND/OR SCALP TREATMENT

OBJECT OF THE INVENTION

The present invention relates to an applicator comb for treating the hair and/or scalp, with which enhancement is obtained of the benefits offered by the existing systems for applying both liquid and viscous products currently employed, though in a more precise, cleaner and quicker manner than is achieved with these conventional methods, providing also a considerable saving in the amount employed of said products.

BACKGROUND TO THE INVENTION

The systems that are presently being employed for applying different hair products, have the disadvantage that, for specific applications (for hair and scalp independently), they are insufficiently precise for the application process and this, in the long run, can lead to problems, if not for the hair itself, then for the scalp due to products producing irritation when coming into contact with it.

In the utility model U-9601817 of the same applicant as the present invention, a perfected comb was made known for hair treatment, the object of which is to facilitate the application of liquid products such as lotions, dyes, etc., in less time, with greater safety and cleanliness, than when employing the methods of conventional systems. It comprises a comb having a hollow main body constituent part of a reservoir for holding the liquid to be used in the treatment. This body leads into tubular teeth the operational ends of which form a curved concave line, instead of terminating in a straight line as is normal practice. The means of impelling the product consists basically of flexible segments in the handle, permitting pressure to be applied manually.

In the international application PCT/ES97/00167 by the same applicant, a comb was made known for hair treatment in which, in addition to the features offered by the aforementioned utility, other benefits are provided such as those indicated below:

The product reservoir is at least in part in the form of a main body from which the teeth radiate, said body having a mouth joined through a means of opening and hermetically closing to the handle. The reservoir incorporates a refillable and/or replaceable cartridge. The teeth can come with a bevel cut and also have multiple perforations practised along them and also incorporate a small brush.

DESCRIPTION OF THE INVENTION

The applicator comb for hair and/or scalp treatment basically offers a feature of interchangeability whereby a single support is capable of being used for different applications of products and treatments for the hair or scalp.

These applicator teeth, in the number of units specified, are coupled or attached to the body acting as common head and which can come in different forms. To this body is fitted an adapted container or receptacle and which is the element that may hold the hair products. On mounting the head on this container, if the latter holds any hair product, the applicator teeth attached absorb a certain amount of said product by capillary action, or else by manual pressure on the pertinent pliable segment or pushbutton, it being possible thereby to apply the product to the hair or scalp according to the version of applicator teeth being employed, as required by the user.

By means of a set of applicator teeth, the structure and distribution of which differ for each application, in accordance with the different versions which shall be remarked later in connection with the figures, a perfect application can be achieved. These applicator teeth can come joined together forming a unit for assembly or replacement, or separate from each other, since certain applicator tooth models or versions cannot be produced as a block. For their use the applicator teeth can be inserted in the body which has been defined as head for a container or receptacle and which at the same time protects the applicator teeth connected to it.

The body serving as head, can come in different shapes, hold one or more applicator teeth, in line or alternated and having different geometric forms. It can also have a concave base to adapt anatomically to the user's head.

As has been indicated above and depending on the application, a first type of applicator tooth has been foreseen having a design to deposit the product on the scalp alone, when the hair is being combed, by means of a permeable fiber which is attached to the back part of the applicator tooth. In this manner, the front part of said applicator tooth provides a means of support and guidance which produces a tiny furrow in the skin of the scalp which the fiber makes use of to impregnate the scalp with the product, avoiding the adsorption of said product by the hair.

Another type of applicator tooth for another application or treatment, mainly for applying viscous products to the scalp or at the base of the hair, incorporates at the operational end, a number of bristles inserted on the back part to facilitate the application process. This arrangement is similar to that mentioned above, the permeable fiber being replaced by bristles.

There is another type of applicator tooth designed to prevent products coming into contact with the scalp, since there are some of these which are harmful to it, such as anti-parasitic lotions.

This last type of applicator tooth mentioned, has both the front and rear of the lower part stiff, while the rest is of permeable fibre. Thus, the product can be deposited on the hair when combing, but is prevented from reaching the scalp and hair roots.

To permit the application of the product indistinctly to the hair and the scalp, stiff-cored applicator teeth can be employed with a permeable fibre cladding which retains the product.

For applying gels or viscous products intended for the hair, applicator teeth can be used with a cladding provided with longitudinal recesses or holes which facilitate the emission, these being possible with or without fibre.

For those applications in which it is necessary for any of the different versions of applicator teeth to have the product continuously available, the head can be fitted with a dosing mechanism which controls the flow of the product to be sent to the application tips connected to the dosing mechanism, said product coming from a cartridge which can be self-actuating. This cartridge can also be refillable or disposable.

To maintain the product in perfect condition, the cartridge comes fitted with a cap having a vacuum valve and in this case the container or receptacle serves to protect the tips.

To facilitate a better understanding of the characteristics of the invention and forming an integral part of this specification, a number of drawings are attached in which figures, in an illustrative and not restrictive manner, the following aspects are shown:

For applying gels or viscous products intended for the hair, teeth can be used with a cladding provided with longitudinal recesses or holes which facilitate the emission, these being possible with or without fibre.

For those applications in which it is necessary for any of the different versions of teeth to have the product continuously available, the head can be fitted with a dosing mechanism which controls the flow of the product to be sent to the application tips connected to the dosing mechanism, said product coming from a cartridge which can be self-actuating. This cartridge can also be refillable or disposable.

To maintain the product in perfect condition, the cartridge comes fitted with a cap having a vacuum valve and in this case the container or receptacle serves to protect the tips.

To facilitate a better understanding of the characteristics of the invention and forming an integral part of this specification, a number of drawings are attached in which figures, in an illustrative and not restrictive manner, the following aspects are shown:

DESCRIPTION OF THE PREFERRED EMBODIMENT

Figure 1:
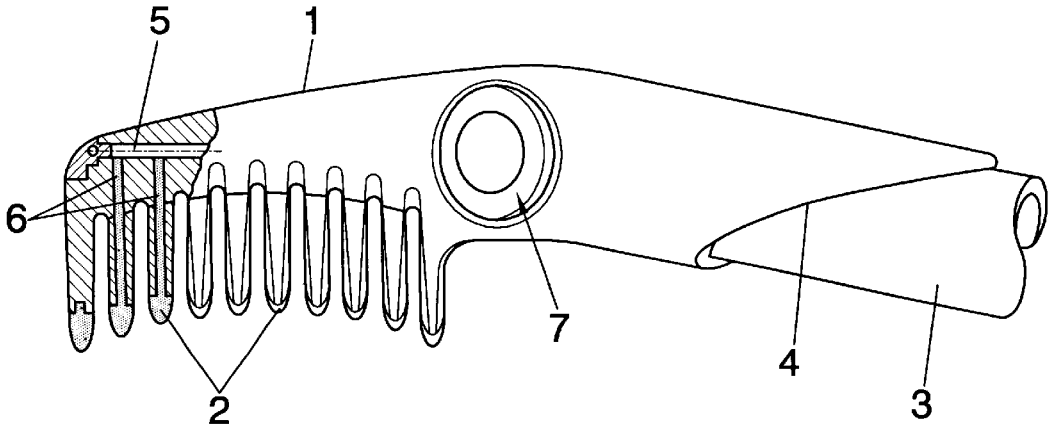
FIG. 1. —Shows a partial longitudinal side view of an applicator comb which includes a set of applicator teeth for hair and/or scalp treatment, in accordance with the invention.
Figure 2:
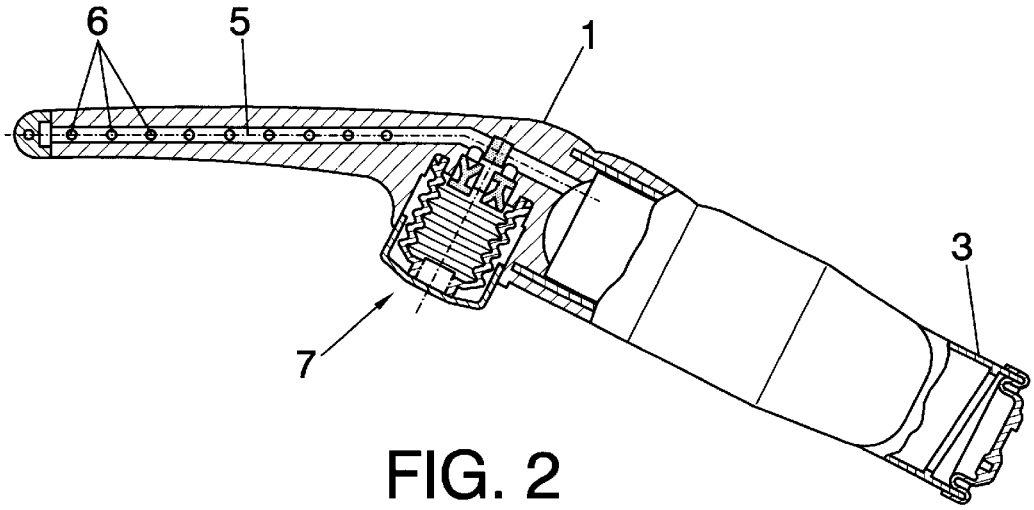
FIG. 2. —Shows a side view of that shown in FIG. 1, with the portion corresponding to the applicator teeth and pushbutton in section.

With reference to the numbering scheme adopted in the figures, it can be seen how the applicator tooth for hair and/or scalp treatment is interchangeable in nature by forming part of an assembly which can be inserted into a tubular body 1 serving as support. The body 1 has connected to it a plurality of applicator teeth 2 of tubular structure through which the product to be applied passes. The product is held in the container 3 joined to the mouthpiece 4 of the tubular body 1. The tubular body 1 is provided in turn with an axial channel 5 and a plurality of side branches 6, the side branches 6 mutually coplanar and in line with the core of the tubular applicator teeth 2, as can be seen in FIG. 1.

When the pushbutton 7 is manually depressed, the product to be applied held in the receptacle or container 3, is fed into the applicator teeth 2. The applicator teeth 2 are detachable and replaceable to permit their insertion into the body 1 and, as has been stated above, depending on the application, they have a Thus, in FIG. 3, an applicator tooth tip model $\mathbf{2}^{I}$ is shown which is employed to deposit the treatment product on the scalp only, by having a permeable fibre 8 on the back part of its extremity. Reference 9 indicates the lateral orifice of the applicator tooth permitting the product to reach the permeable fibre 8. The front part 10 of this applicator tooth $\mathbf{2}^{I}$, being of a stiff material, produces a furrow in order that the back part 8 only applies the product to the scalp.

Figure 3:
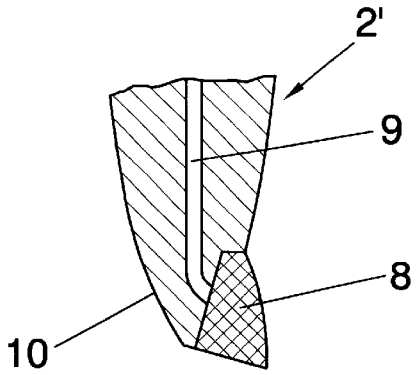
FIG. 3. —Shows a partial sectional view, of the end of an applicator tooth with a permeable fibre on the back part.
Figure 4:
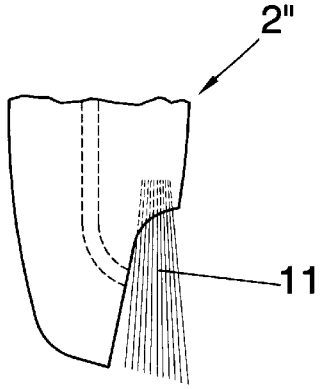
FIG. 4. —Shows a view of the end of an applicator tooth which incorporates pliable bristles on the back part.

In FIG. 4 the reference $\mathbf{2}^{II}$, is given to an applicator tooth of which the rear extremity has bristles 11 instead of the permeable fibre 8 of FIG. 3. As has been indicated earlier, this permits the product to be applied only to the base of the hair or scalp.

Figure 5:
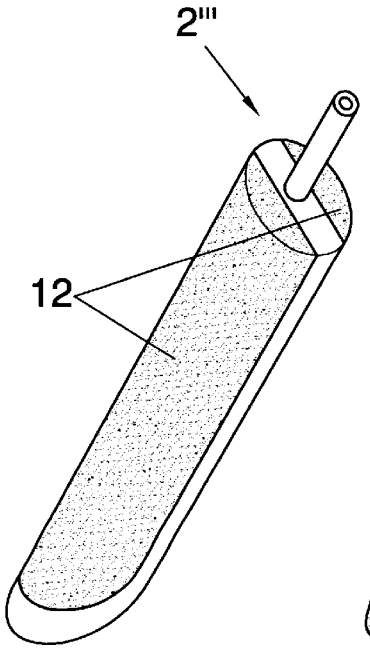
FIGS. 5 to 7. —Show respective views in perspective of different models of applicator teeth for different hair and/or scalp treatments.

The applicator tooth $\mathbf{2}^{III}$ shown in FIG. 5, has a structure designed precisely to prevent contact between the product and the scalp, the former being deposited only on the hair when combed. The lower part of the end of the tip and the front and back thereof, are stiff, while on the sides there is a permeable fibre 12 for impregnating the hair.

Figure 6:
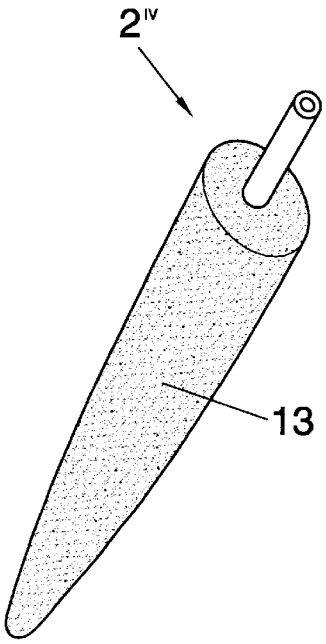

In FIG. 6, the applicator tooth having reference $\mathbf{2}^{IV}$, has a rigid structure sheathed in a layer of permeable fibre 13, suitable for applying the product indistinctly to the hair or to the scalp, permitting all the hair to be moistened or wetted with any type of product.

Figure 7:
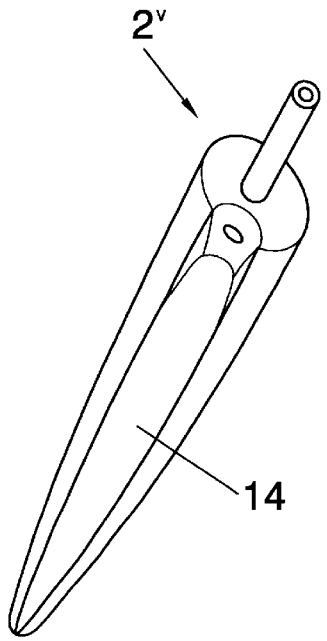

The applicator tooth shown in FIG. 7, having reference $\mathbf{2}^{V}$, works by capillary action in like manner to a pen nib or a draughtsman's pen, having a longitudinal opening 14 through which the product to be applied is fed. The applicator tooth is given this structure in order to permit the application of denser or more adherent products.

What is claimed is:

1. A device usable as an applicator comb for hair and scalp treatment comprising a tubular body containing a receptacle for holding a product to be applied, said product being selected from liquid or gelatinous products;

at least one applicator tooth, comprising a tubular structure to permit the product be applied;

means to provoke the product to be ejected;

a plurality of sockets provided on a surface of the tubular body to which said at least one applicator tooth is connected;

wherein the applicator tooth comprises, a stiff impermeable strip substantially perpendicular to an axial channel of the tubular body, said strip having, a stiff front edge and a stiff rear edge according to a combing direction;

a lower end with a stiff tip portion; permeable fibre arranged on both sides of said strip to allow the product to be applied to the hair only, without the product coming into contact with the scalp.

2. A device according to claim 1, wherein a plurality of teeth are fastened to each other, forming a unit for assembly to the tubular body.

3. A device according to claim 2, wherein the tubular body includes a dosing mechanism with a pushbutton situated at an easily accessible point on one side of the tubular body.

4. A device according to claim 1, wherein the sockets are arranged in alignment.

5. A device usable as an applicator comb for hair and scalp treatment comprising a tubular body containing a receptacle for holding a product to be applied, said product being selected from liquid or gelatinous products;

at least one applicator tooth, comprising a tubular structure to permit the product be applied; means to eject the product;

a plurality of sockets provided on a surface of the tubular body to which said at least one applicator tooth is connected;

wherein the applicator tooth comprises, a front lower end and a rear lower end according to a combing direction;

a permeable fibre arranged on the rear lower end of said applicator tooth, the front portion of said applicator tooth serving to create a furrow into which the permeable fibre discharges, whereby the applicator tooth is suitable for applying the product only to the scalp.

6. A device according to claim 5, wherein a plurality of applicator teeth are fastened to each other, forming a unit for assembly to the tubular body.

7. A device according to claim 6, wherein the tubular body includes a dosing mechanism with a pushbutton situated at an easily accessible point on one side of the tubular body.

8. A device according to claim 5, wherein the sockets are arranged in alignment.

* * * * *